US011557836B2

(12) United States Patent
Ai

(10) Patent No.: US 11,557,836 B2
(45) Date of Patent: Jan. 17, 2023

(54) MANUAL ACTUATING DEVICE FOR PHASE SHIFTER AND SUPPORTING SYSTEM

(71) Applicant: CommScope Technologies LLC, Hickory, NC (US)

(72) Inventor: Bin Ai, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 16 days.

(21) Appl. No.: 17/225,676

(22) Filed: Apr. 8, 2021

(65) Prior Publication Data

US 2021/0336335 A1 Oct. 28, 2021

(30) Foreign Application Priority Data

Apr. 27, 2020 (CN) ..... 202010341696.X

(51) Int. Cl.
*H01Q 3/32* (2006.01)
*H01Q 1/24* (2006.01)

(52) U.S. Cl.
CPC ..... *H01Q 3/32* (2013.01); *H01Q 1/246* (2013.01)

(58) Field of Classification Search
CPC ..... H01Q 3/32
See application file for complete search history.

(56) References Cited

U.S. PATENT DOCUMENTS

2018/0031092 A1* 2/2018 Daniel ..... F16H 57/04
2020/0220260 A1* 7/2020 Li ..... H01Q 3/08

FOREIGN PATENT DOCUMENTS

CN 203721883 U 7/2014
CN 107305976 A * 10/2017 ..... H01Q 1/42
CN 207338646 U 5/2018

* cited by examiner

*Primary Examiner* — Daniel Munoz
(74) *Attorney, Agent, or Firm* — Myers Bigel, P.A.

(57) ABSTRACT

The invention relates to a manual actuating device for a phase shifter of a base station antenna. The device includes a support module having an elongated base body and a first and a second receiving portion which protrude from the base body and are spaced apart in a longitudinal direction of the base body; and a lead screw drive having a lead screw and a nut. The lead screw is rotatably supported in the first and the second receiving portion, and the nut is translationally movably installed on the lead screw. The device also includes an actuator rod connected to the nut and configured to actuate the phase shifter; and a manual operating part connected with the lead screw and configured to manually operate the lead screw to rotate the lead screw. The actuating device is simple and compact in structure and is easy to manufacture and install.

20 Claims, 3 Drawing Sheets

MANUAL ACTUATING DEVICE FOR PHASE SHIFTER AND SUPPORTING SYSTEM

RELATED APPLICATION

The present application claims priority to and the benefit of Chinese Patent Application No. 202010341696.X, filed Apr. 27, 2020, the content of which is hereby incorporated herein in its entirety.

FIELD OF THE INVENTION

The invention relates to the field of base station antennas and in particular to a manual actuating device for a phase shifter.

BACKGROUND

Phase shifters are widely used in base station antennas to adjust the electrical tilt angles of the antenna beams formed by the base station antennas. A phase shifter can be actuated (moved) by an electric actuating device in order to adjust the electrical tilt angles. Typically, an electric actuating device has a complicated structure, a large number of parts and requires a large installation space within the base station antenna. For example, the utility model CN207338646U discloses such an electric actuating device for a phase shifter.

SUMMARY

Embodiments of the invention are directed to a manual actuating device for a phase shifter which has a relatively simple and compact structure.

Embodiments of the invention provide a supporting system.

Embodiments of the invention are directed to a manual actuating device for a phase shifter. The actuating device includes: a support module having an elongated base body and a first and a second receiving portion protruding from the base body and spaced apart in a longitudinal direction of the base body; and a lead screw drive having a lead screw and a nut. The lead screw is rotatably supported in the first receiving portion and the second receiving portion, and the nut is translationally movably mounted on the lead screw. The device also includes an actuator rod connected to the nut and configured to actuate the phase shifter, and a manual operating part connected with the lead screw and configured to manually operate the lead screw to rotate the lead screw.

The manual actuating device for the phase shifter according to the present invention may have a simple and compact structure, has a small number of parts, is easy to manufacture and assemble, and requires a small installation space.

In some embodiments, the first receiving portion may include a first through hole.

In some embodiments, the first receiving portion may include a first bearing fixedly mounted in the first through hole for bearing the lead screw.

For example, the first bearing may be made of a first plastic material that is more wear resistant than the base body material, and the base body of the support module may be made of a second plastic material that is cheaper.

In some embodiments, the first bearing may be configured for mounting into the first through hole from a side of the first through hole facing away from the second receiving portion.

In some embodiments, the first bearing may be integrally formed in the first receiving portion.

In some embodiments, the first through hole and the first bearing may have axial stops that match each other, the axial stops defining an axial position of the first bearing relative to the first through hole.

In some embodiments, the first through hole and the first bearing may have circumferential stops that match each other, the circumferential stops defining a circumferential position of the first bearing relative to the first through hole.

In some embodiments, the axial stop of the first through hole may be a step of the first through hole, and the axial stop of the first bearing may be a flange of the first bearing.

In some embodiments, the circumferential stop of the first through hole may be a radial recess of the first through hole, and the circumferential stop of the first bearing may be a radial protrusion of the first bearing.

In some embodiments, the first bearing may be fixed by a fastening element mounted in a receiving hole of the first receiving portion.

In some embodiments, the first bearing may have a recess configured to receive a rotating tool, such as a screwdriver or a wrench, for rotating the first bearing.

In some embodiments, the first receiving portion may have at least one first flange in a first plane transverse to a longitudinal axis of the first through hole and at least one second flange which is in a second plane parallel to the first plane and is offset from the first flange in a circumferential direction of the first through hole, and the first bearing may have a third flange which has a radial protrusion, wherein the third flange abuts against the second flange and is configured for rotation about a predetermined angle so that the third flange is clamped between the first and the second flange and the radial protrusion is stopped in a rotation direction, wherein the first receiving portion has a receiving hole, in which a fastening element can be inserted, which is configured to stop rotation of the radial protrusion in a direction opposite to the rotation direction.

In some embodiments, the first receiving portion may have two opposed first flanges and two opposed second flanges, and the first bearing may have two opposed third flanges.

In some embodiments, the fastening element may be a screw, a pin or a push rivet.

In some embodiments, the lead screw may have a flange that can pass through the first through hole, and the lead screw is axially stopped by the first bearing through the flange.

In some embodiments, the second receiving portion may include a second hole. For example, the second hole may be a through hole.

In some embodiments, the second receiving portion may include a second bearing fixedly mounted in the second hole for bearing the lead screw.

In some embodiments, the second bearing may be configured for mounting into the second hole from a side of the second hole facing the first receiving portion.

In some embodiments, the second hole and the second bearing may have axial stops that match each other, and the axial stops of the second hole and the second bearing define an axial position of the second bearing relative to the second hole.

In some embodiments, the second hole and the second bearing may have circumferential stops that match each other, and the circumferential stops of the second hole and the second bearing define a circumferential position of the second bearing relative to the second hole.

In some embodiments, the axial stop of the second hole may be a step of the second hole, and the axial stop of the second bearing may be a flange of the second bearing.

In some embodiments, the circumferential stop of the second hole may be a protrusion of the second hole, and the circumferential stop of the second bearing may be a slot of the flange of the second bearing.

In some embodiments, the nut may have a tab, and the base body of the support module may have a guide groove extending in its longitudinal direction, the tab protruding into the guide groove and being configured to move along the guide groove.

In some embodiments, the actuator rod may be detachably connected to the nut.

In some embodiments, the nut may have a snap element for a snap connection with the actuator rod.

In some embodiments, the nut may have a pin element and the actuator rod has a pin hole for receiving the pin element.

In some embodiments, the base body of the support module may have a clamping portion for guiding the actuator rod.

In some embodiments, the actuator rod may be provided with a first stop that acts with the clamping portion to limit a stroke of the actuator rod in a push-out direction.

In some embodiments, the first stop may be mounted in the actuator rod as a separate component.

In some embodiments, the first stop may be an integral part of the actuator rod.

In some embodiments, a proximal end of the actuator rod may form a second stop that is configured to act in concert with the first receiving portion to define a stroke of the actuator rod in a retraction direction.

In some embodiments, the manual operating part may be configured as a knob that is fixedly connected to the lead screw.

In some embodiments, the manual operating part may be configured as a knob that is integrally formed with the lead screw.

In some embodiments, the knob may be configured as a star wheel.

In some embodiments, the knob and the lead screw may have bores that can be aligned with each other, wherein the bores are configured to receive an insertion element for fixedly connecting the knob with the lead screw.

In some embodiments, the actuating device may include an additional support.

In some embodiments, the additional support may have a first receiving hole, and the nut of the lead screw drive may have a second receiving hole, wherein a scale is received within the first and the second receiving hole, the scale having scale values for representing electric tilt angles corresponding to actuator rod positions.

In some embodiments, the scale may be provided with a spring element, a proximal end region of the scale may abut against an edge of the first receiving hole under a spring force of the spring element, and the scale can be pulled out from the first receiving hole and the second receiving hole against the spring force of the spring element until a distal end region of the scale abuts against an edge of the second receiving hole.

In some embodiments, the additional support may have a third receiving hole through which the manual operating part extends.

In some embodiments, a resistance element may be provided between the manual operating part and the third receiving hole, and the resistance element can generate resistance for operation of the manual operating part.

The resistance element may be an elastomeric element. Alternatively, or additionally thereto, the resistance element may be a releasable connection such as a pin-hole connection.

In some embodiments, the base body of the support module may have a plurality of fixing holes configured to receive fixing elements for fixing the base body, such as screws, push rivets or pins.

In some embodiments, at least one, e.g., all, of the support module, the manual operating part, the lead screw drive, and the actuator rod may be made of nonmetallic materials, e.g., plastic materials, e.g., glass fiber reinforced plastic materials.

Other embodiments are directed to a supporting system. The supporting system includes a receiving component with a through hole and a bearing configured to be mounted in the through hole. The receiving component has at least one first flange in a first plane transverse to a longitudinal axis of the through hole and at least one second flange which is in a second plane parallel to the first plane and is offset from the first flange in a circumferential direction of the through hole, and the bearing has a third flange which has a radial protrusion. The third flange abuts against the second flange with and then can be rotated about a predetermined angle so that the third flange is clamped between the first and the second flange and the radial protrusion is stopped in a rotation direction. The receiving component has a receiving hole, in which a fastening element can be inserted, which is configured to stop rotation of the radial protrusion in a direction opposite to the rotation direction.

Such a supporting system may be used with the aforementioned actuating device in a base station antenna. For example the first and/or the second receiving portion of the support module of the actuating device may have such a supporting system.

In some embodiments, the first receiving portion may have two opposed first flanges and two opposed second flanges, and the first bearing may have two opposed third flanges.

In some embodiments, the fastening element may be a screw, a pin or a push rivet.

BRIEF DESCRIPTION OF DRAWINGS

The present invention will now be described in more detail by means of embodiments with reference to the accompanying drawings. The schematic drawings are briefly introduced as follows.

DETAILED DESCRIPTION

The present invention will be described below with reference to the accompanying drawings. The drawings illustrate embodiments of the present invention. However, it should be understood that the present invention can be presented in many different ways and is not limited to the embodiments described below. In fact, the embodiments described below are intended to make the disclosure of the present invention more complete and to fully explain the protection scope of the invention to those skilled in the Art. It should also be understood that the embodiments disclosed herein can be combined in various ways to provide more additional embodiments.

It should be understood that the terminology used in the specification is only for describing specific embodiments and is not intended to limit the present invention. All terms used in the specification have the meanings commonly understood by those skilled in the art unless otherwise defined. For the sake of simplicity and clarity, well-known functions or structures may not be described in detail. The terms "comprising", "including" and "containing" in the specification indicate the presence of the claimed features, but do not exclude the presence of one or more other features.

Figure 1:
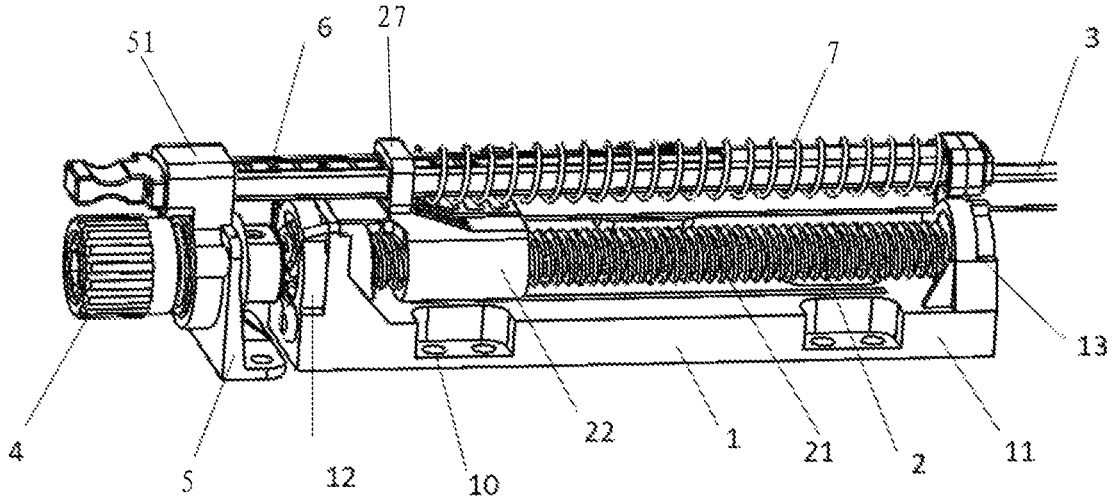
FIG. 1 is a perspective view of a manual actuating device for a phase shifter according to an embodiment of the present invention.
Figure 2:
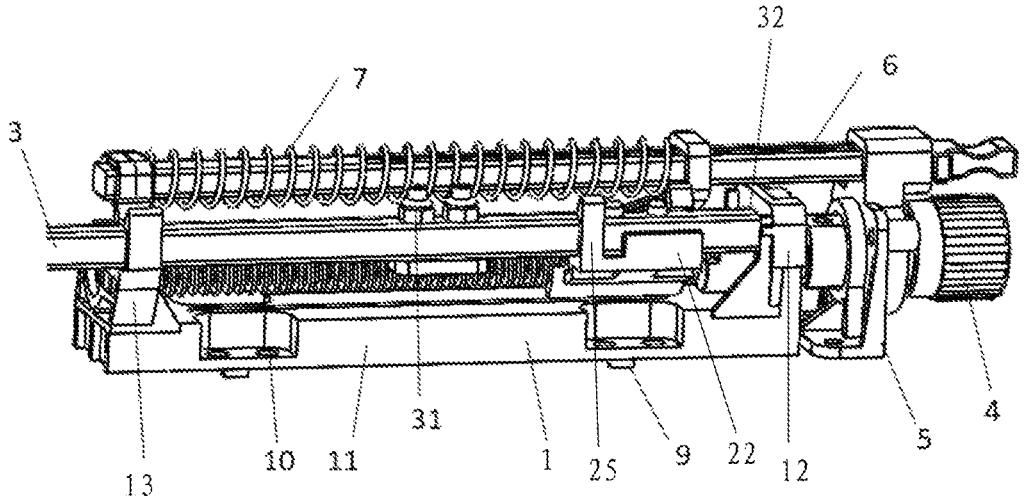
FIG. 2 is another perspective view of the actuating device of FIG. 1.
Figure 3:
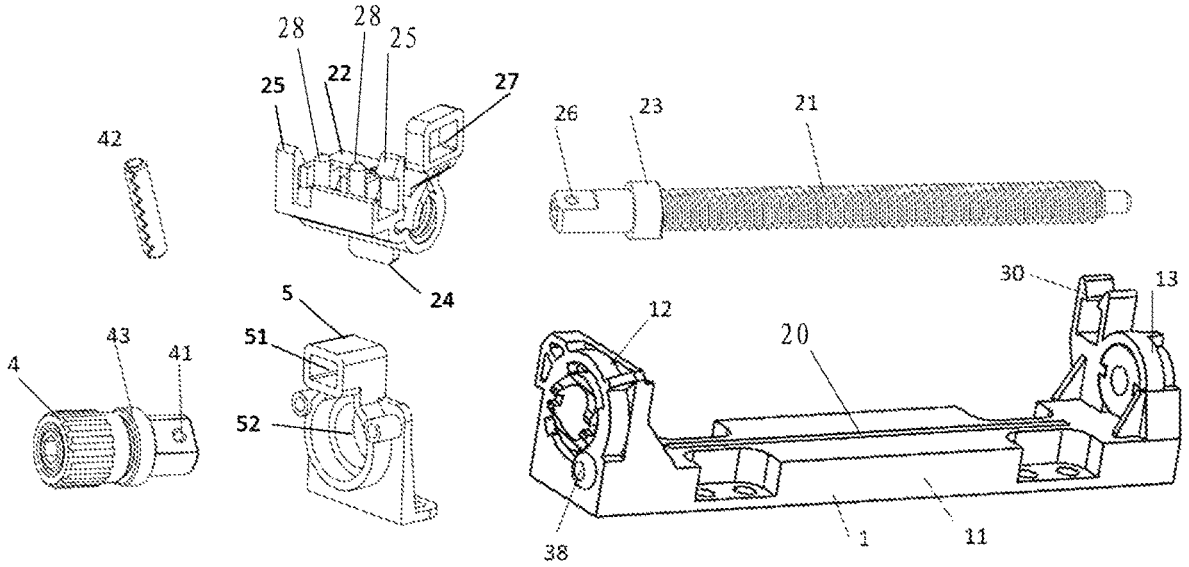
FIG. 3 is an exploded view of components of the actuating device of FIG. 1.
Figure 5:
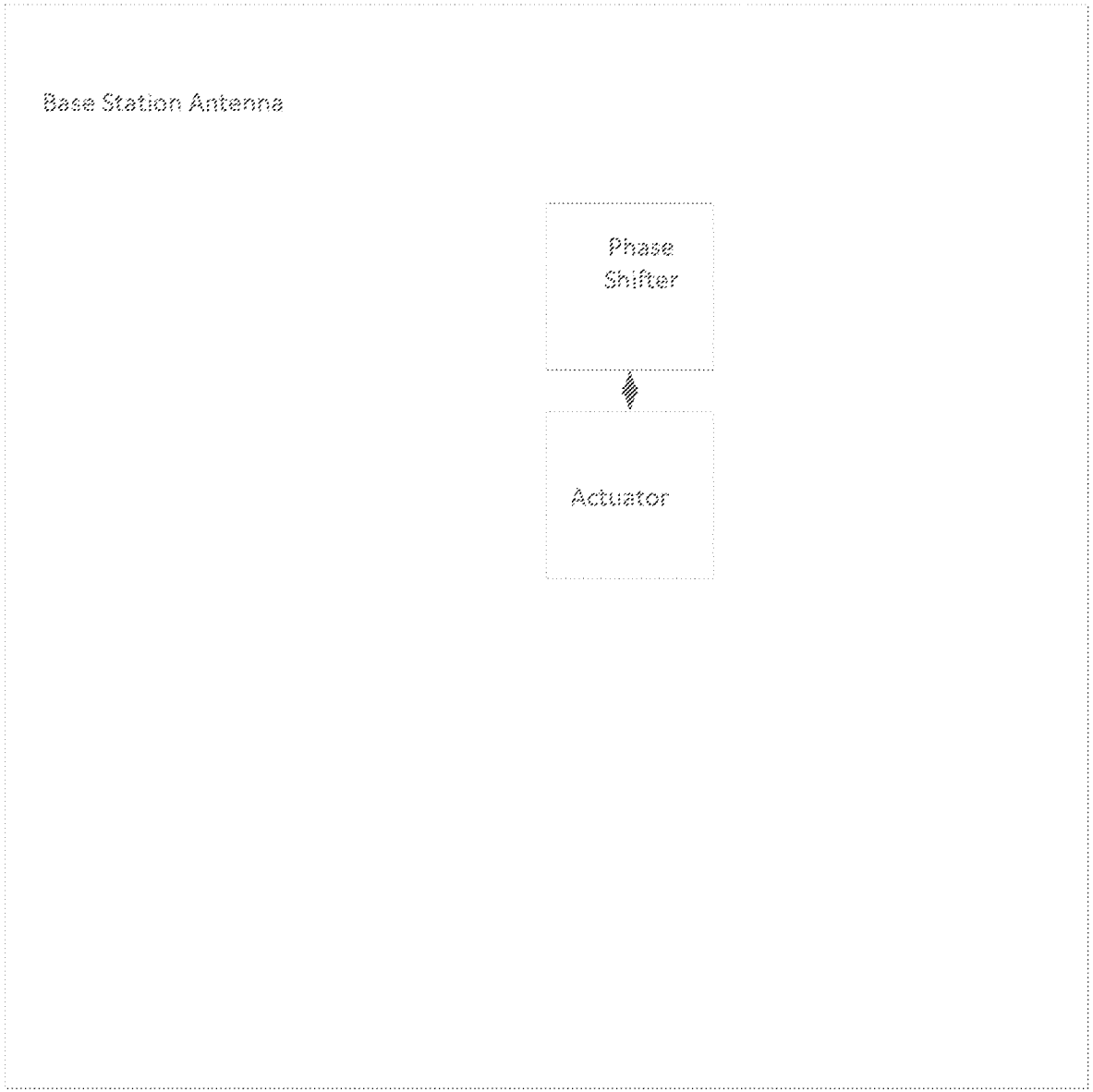
FIG. 5 is a block diagram of a base station antenna with the manual actuating device and phase shifter.

FIGS. 1 and 2 are different perspective views of a manual actuating device for a phase shifter according to an embodiment of the present invention. FIG. 5 is a block diagram of a base station antenna with the manual actuating device and the phase shifter. FIG. 3 is an exploded view of components of the actuating device of FIG. 1, where the actuator rod 3, scale 6 and spring 7 are omitted to better illustrate other of the components.

The actuating device comprises a support module 1, a lead screw drive 2, an actuator rod 3 and a manual operating part 4. The lead screw drive 2 is supported in the support module 1 and is connected to the actuator rod 3 and the manual operating part 4. The lead screw drive 2 has a lead screw 21 and a nut 22. The nut 22 is translationally movably mounted on the lead screw 21. The lead screw 21 is connected to the manual operating part 4. The manual operating part 4 is operatively connected to the lead screw 21 so that manual movement (here rotation) of the manual operating part 4 acts to rotate the lead screw 21. The nut 22 is connected to the actuator rod 3, and the actuator rod 3 and the nut 22 move together. A length of the actuator rod 3 can be selected according to actual needs. For example, the actuator rod 3 may extend from the actuating device to a phase shifter. The actuator rod 3 is partially shown in FIGS. 1 and 2.

At least one, for example all, of the support module 1, the lead screw drive 2, the actuator rod 3, and the manual operating part 4 may be made of nonmetallic materials such as plastic materials. This can reduce the weight and manufacturing costs of the actuating device and may also remove potential sources of passive intermodulation distortion (PIM).

The support module 1 has an elongated base body 11, a first receiving portion 12 and a second receiving portion 13 protruding from the base body 11. The first receiving portion 12 and the second receiving portion 13 are spaced apart in a longitudinal direction of the base body 11. The lead screw 21 is rotatably supported in the first receiving portion 12 and the second receiving portion 13 of the support module 1.

Figure 4A:
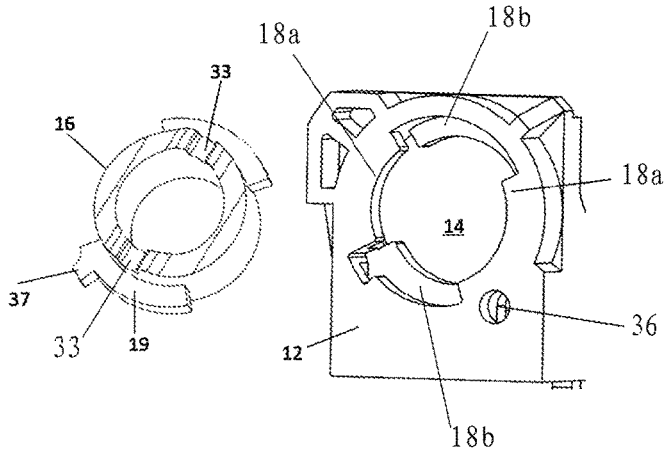
FIG. 4A is an exploded view of the first receiving portion of the actuating device of FIG. 1.

FIG. 4A is an exploded partial view of the first receiving portion 12 of the actuating device of FIG. 1. As shown in FIG. 4A, the first receiving portion 12 may include a first through hole 14 and a first bearing 16 that is fixedly mounted in the first through hole 14 for bearing the lead screw 21. For example, a first end of the lead screw 21 may be supported in the first bearing 16. In order to fixedly arrange the first bearing 16 in the first through hole 14, the first through hole 14 and the first bearing 16 may have matching axial stops and/or matching circumferential stops. The axial stops may define an axial position of the first bearing 16 relative to the first through hole 14. As shown in FIG. 4A, the axial stop of the first through hole 14 may be a flange of the first through hole 14, and for example two opposed first flanges 18*a* in a first plane and two opposed second flanges 18*b* in a second plane and offset to the first flanges in a circumferential direction may be arranged. Thus the axial stop of the first bearing 16 may be limited on both sides in an axial direction. The axial stop of the first bearing 16 may be a flange 19 (it may also be referred as a third flange) of the first bearing 16, for example, a pair of flanges 19 may be provided. The circumferential stops may define a circumferential position of the first bearing 16 relative to the first through hole 14. The circumferential stop of the first through hole 14 may be a radial concave portion of the first through hole 14. The circumferential stop of the first bearing 16 may be a radial protrusion 37 of the first bearing 16. The first bearing 16 may be fixed by a fastening element 38 that is installed into a receiving hole 36 of the first receiving portion 12. The fastening element 38 may be, for example, a screw, a pin or a push rivet.

The first bearing 16 may be configured to be installed into the first through hole 14 from a side of the first through hole 14 facing away from the second receiving portion 13. As shown in FIG. 4A, the first bearing 16 can be moved from the left to the right in the view of FIG. 4A into the first through hole 14. Initially, the flanges 19 of the first bearing 16 abut against the flanges 18*b*, and then the first bearing 16 may be rotated about a predetermined angle, and the first bearing 16 may then be rotated (e.g., using a screwdriver inserted into the recesses 33) until the radial projection 37 is stopped by a stop in the first receiving portion 12 which is not visible in FIG. 4A, so that the flanges 19 are clamped between the first and the second flanges 18*a*, 18*b*. Finally, the fastening element 38 (see FIG. 3) may be installed in the receiving hole 36 to prevent further rotation of the first bearing 16.

Figure 4B:
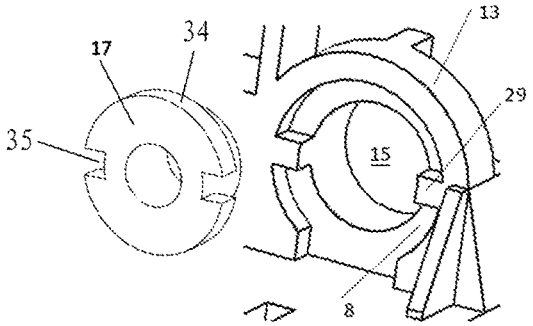
FIG. 4B is an exploded view of the second receiving portion of the actuating device of FIG. 1.

FIG. 4B is an exploded partial view of the second receiving portion 13 of the actuating device of FIG. 1. As shown in FIG. 4B, the second receiving portion 13 may include a second hole 15 and a second bearing 17 is fixedly provided in the second hole 15 for bearing the lead screw 21. The second hole 15 may be configured as a second through hole. For example, the second end of the lead screw 21 may be supported in the second bearing 17. The second bearing 17 may be configured for mounting in the second hole 15 from a side of the second hole 15 facing the first receiving portion 12. In order to fixedly arrange the second bearing 17 in the second hole 15, the second hole 15 and the second bearing 17 may have matching axial stops and/or matching circumferential stops. The axial stops may define an axial position of the second bearing 17 relative to the second hole 15. As shown in FIG. 4B, the axial stop of the second hole 15 may be a step 8 of the second hole 15. The axial stop of the second bearing 17 may be a flange 34 of the second bearing 17. The circumferential stops may define a circumferential position of the second bearing 17 relative to the second hole 15. As shown in FIG. 4B, the circumferential stop of the second hole 15 may be a protrusion 29 of the second hole 15. The circumferential stop of the second bearing 17 may be a slot 35 of the flange 34 of the second bearing 17. In the assembled status, the flange 34 of the second bearing 17 abuts against the step 8 of the second hole 15, and the slot 35 engages with the protrusion 29.

The base body 11 may be configured with hooks 9. As shown in FIG. 2, the hooks 9 may be constructed on the bottom of the base body 11. The hooks 9 are configured for pre-positioning the base body 11 during installation. The base body 11 may have a plurality of fixing portions 10 for finally fixing the support module 1, for example, by screws. The base body 11 may be configured with a clamping portion 30 for guiding the actuator rod 3.

The nut 22 of the lead screw drive 2 is mounted on the lead screw 21 in a non-rotatable manner. The nut 22 is configured to move axially along the lead screw 21. In order to prevent rotation of the nut 22 on the lead screw 21, the nut 22 may include a tab 24. Correspondingly, the base body 11 may be configured with a guide groove 20 extending in its longitudinal direction. The tab 24 protrudes into the guide groove 20 and can move along the guide groove 20 while preventing rotation of the nut 22.

The nut 22 of the lead screw drive 2 is connected to the actuator rod 3. Accordingly, movement of the nut 22 is transferred to the actuator rod which in turn actuates the phase shifter. The nut 22 may be detachably connected to the actuator rod 3. For example, the nut 22 may have a snap element 25 for snap connection with the actuator rod 3. Alternatively, or additionally thereto, the nut 22 may have a pin element 28, and the actuator rod 3 may have a pin hole for receiving the pin element 28. The stroke of the actuator rod 3 can be suitably limited. For example, the actuator rod 3 may be provided with a first stop 31, which may act with the clamping portion 30 of the base body 11 to limit the stroke of the actuator rod 3 in a push-out direction. The first stop 31 may be mounted in the actuator rod 3 as a separate component. For example, a proximal end of the actuator rod 3 may form a second stop 32. The second stop 32 may act with the first receiving portion 12 to limit the stroke of the actuator rod 3 in a retracting direction. Alternatively, or additionally thereto, the stroke limit of the actuator rod 3 can also be realized by limiting the movement of the tab 24 in the guide groove 20. For this purpose, stops for the tab 24 may be provided in the guide groove 20.

The manual operating part 4 may be configured as a knob, which may be fixedly connected to the lead screw 21. For example, in order to fixedly connect the knob with the lead screw 21, the knob and the lead screw may have respective bores 41, 26, which can be aligned with each other and receive an insertion element 42. The insertion element 42 may be, for example, a bolt. In some embodiments not shown, at least one of the operating part 4 and the lead screw 21 may be provided with a plurality of bores. As shown in FIG. 3, the first end of the lead screw 21 may have a non-circular cross-section such as a flat cross-section. Correspondingly, a cavity complementary to the first end of the lead screw 21 may be formed in the operating part 4. The first end of the lead screw 21 can be inserted into the cavity of the operating part 4 so as to realize a non-rotating connection between the operating part 4 and the lead screw 21 (so that rotation of the operating part 4 will result in corresponding rotation of the lead screw 21). In addition, as shown in FIG. 3, the lead screw 21 may have a flange 23 that can pass through the first through hole 14, but that cannot pass through the first bearing 16. Thus, the lead screw 21 can be axially limited by the first bearing 16.

The actuating device may further comprise an additional support 5. When the additional support 5 is constructed separately from the support module 1, installation can be flexibly realized. The additional support 5 may also be integrally formed with the support module 1. The actuating device may further include a scale 6 that is displays, for example, an electric tilt angle applied by the phase shifter actuated by the actuating device to an antenna beam formed by the base station antenna. The additional support 5 may be provided with a first receiving hole 51, and the nut 22 of the lead screw drive 2 may be provided with a second receiving hole 27. The scale 6 is received in the first receiving hole 51 and the second receiving hole 27. The scale 6 may have scale values for representing electric tilt angles corresponding to positions of the actuator rod 3. The scale 6 may be provided with a spring element 7. A proximal end region of the scale may abut against an edge of the first receiving hole 51 under a spring force of the spring element 7. The scale 6 can be pulled from the first receiving hole 51 and the second receiving hole 27 against the force of the spring element 7 until a distal end region of the scale 6 abuts against an edge of the second receiving hole 27 so that the electric tilt angle value can be read from the scale. The additional support 5 may be used to support the manual operating part 4. The additional support 5 may have a third receiving hole 52 through which the manual operating part 4 extends. An elastomeric element 43 may be provided between the manual operating part 4 and the third receiving hole 52. As to the operation of the operating part 4, the elastomeric element can generate resistance, so unintentional rotation of the operating part 4 can be avoided.

It will be understood that the terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprise" and "include" (and variants thereof), when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween. In contrast, terms such as "directly on," "directly coupled to" and "directly connected to," when used herein, indicate that no intervening elements are present. Other words used to describe the relationship between elements should be interpreted in a like fashion (i.e., "between" versus "directly between", "attached" versus "directly attached," "adjacent" versus "directly adjacent", etc.).

Terms such as "top," "bottom," "upper," "lower," "above," "below," and the like are used herein to describe the relationship of one element, layer or region to another element, layer or region as illustrated in the figures. It will be understood that these terms are intended to encompass different orientations of the device in addition to the orientation depicted in the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

It will also be appreciated that all example embodiments disclosed herein can be combined in any way.

Finally, it is to be noted that, the above-described embodiments are merely for understanding the present invention but not constitute a limit on the protection scope of the present invention. For those skilled in the art, modifications may be made on the basis of the above-described embodiments, and these modifications do not depart from the protection scope of the present invention.

What is claimed is:

1. A manual actuating device for a phase shifter, wherein the actuating device comprises:

a support module having a base body that is elongate and that has a first receiving portion and a second receiving portion protruding from the base body and spaced apart in a longitudinal direction of the base body, wherein the base body has a planar primary surface that extends between the first and second receiving portions;

a lead screw drive having a lead screw and a nut, wherein the lead screw is rotatably supported in the first and the second receiving portion, and the nut is translationally movably mounted on the lead screw, and wherein the base body resides entirely under the nut and lead screw between the first and second receiving portions;

an actuator rod connected to the nut and configured to actuate the phase shifter; and a manual operating part connected with the lead screw and configured to manually operate the lead screw to rotate the lead screw.

2. The manual actuating device for a phase shifter according to claim 1, wherein the first receiving portion comprises a first through hole and a first bearing fixedly mounted in the first through hole for bearing the lead screw.

3. The manual actuating device for a phase shifter according to claim 2, wherein the first bearing is configured to be mounted in the first through hole from a side of the first through hole facing away from the second receiving portion.

4. The manual actuating device for a phase shifter according to claim 2, wherein the first bearing has a recess configured to receive a rotating tool for rotating the first bearing.

5. The manual actuating device for a phase shifter according to claim 1, wherein the second receiving portion comprises a second hole and a second bearing fixedly mounted in the second hole for bearing the lead screw, and wherein the second bearing is configured to be mounted in the second hole from a side of the second hole facing the first receiving portion.

6. The manual actuating device for a phase shifter according to claim 1, wherein the nut has a tab, the base body of the support module has a guide groove extending in a longitudinal direction of the base body, and the tab protrudes into the guide groove and is configured to move along the guide groove.

7. The manual actuating device for a phase shifter according to claim 1, wherein the actuator rod is detachably connected with the nut, and wherein the nut has a snap element for snap connection with the actuator rod, and/or the nut has a pin element and the actuator rod has a pin hole for receiving the pin element.

8. The manual actuating device for a phase shifter according to claim 1, wherein the base body of the support module has a clamping portion for guiding the actuator rod, and wherein the actuator rod is provided with a first stop which acts with the clamping portion to limit a stroke of the actuator rod in a push-out direction.

9. The manual actuating device for a phase shifter according to claim 1, wherein a proximal end of the actuator rod forms a second stop, which is configured to act in concert with the first receiving portion to limit a stroke of the actuator rod in a retraction direction.

10. The manual actuating device for a phase shifter according to claim 1, wherein the manual operating part is configured as a knob fixedly connected to the lead screw.

11. The manual actuating device for a phase shifter according to claim 1, wherein the support module, the lead screw drive, the actuator rod, and the manual operating part comprise plastic material(s).

12. A manual actuating device for a phase shifter, wherein the actuating device comprises:

a support module having an elongated base body and a first and a second receiving portions protruding from the base body and spaced apart in a longitudinal direction of the base body;

a lead screw drive having a lead screw and a nut, wherein the lead screw is rotatably supported in the first and the second receiving portion, and the nut is translationally movably mounted on the lead screw;

an actuator rod connected to the nut and configured to actuate the phase shifter; and a manual operating part connected with the lead screw and configured to manually operate the lead screw to rotate the lead screw, wherein the first receiving portion comprises a first through hole and a first bearing fixedly mounted in the first through hole for bearing the lead screw, wherein the first bearing is configured to be mounted in the first through hole from a side of the first through hole facing away from the second receiving portion, and wherein the first through hole and the first bearing have matching axial stops which define an axial position of the first bearing relative to the first through hole, and/or matching circumferential stops which define a circumferential position of the first bearing relative to the first through hole.

13. The manual actuating device for a phase shifter according to claim 12, wherein the first receiving portion has at least one first flange in a first plane transverse to a longitudinal axis of the first through hole and at least one second flange which is in a second plane parallel to the first plane and is offset from the first flange in a circumferential direction of the first through hole, and the first bearing has a third flange which has a radial protrusion, wherein the third flange abuts against the second flange and is configured for rotation about a predetermined angle so that the third flange is clamped between the first and the second flange and the radial protrusion is stopped in a rotation direction, and wherein the first receiving portion has a receiving hole in which a fastening element can be inserted, the fastening element configured to stop rotation of the radial protrusion in a direction opposite to the rotation direction.

14. The manual actuating device for a phase shifter according to claim 13, wherein the first receiving portion has two opposed first flanges and two opposed second flanges, wherein the first bearing has two opposed third flanges and optionally wherein the fastening element is a screw, a pin or a push rivet.

15. A manual actuating device for a phase shifter, wherein the actuating device comprises:

a support module having an elongated base body and a first and a second receiving portions protruding from the base body and spaced apart in a longitudinal direction of the base body;

a lead screw drive having a lead screw and a nut, wherein the lead screw is rotatably supported in the first and the second receiving portion, and the nut is translationally movably mounted on the lead screw;

an actuator rod connected to the nut and configured to actuate the phase shifter; and a manual operating part connected with the lead screw and configured to manually operate the lead screw to rotate the lead screw, wherein the first receiving portion comprises a first through hole and a first bearing fixedly mounted in the first through hole for bearing the lead screw, and wherein the lead screw has a flange which can pass through the first through hole and through which the lead screw is axially limited by the first bearing.

16. A manual actuating device for a phase shifter, wherein the actuating device comprises:

a support module having an elongated base body and a first and a second receiving portions protruding from the base body and spaced apart in a longitudinal direction of the base body;

a lead screw drive having a lead screw and a nut, wherein the lead screw is rotatably supported in the first and the second receiving portion, and the nut is translationally movably mounted on the lead screw;

an actuator rod connected to the nut and configured to actuate the phase shifter; and a manual operating part connected with the lead screw and configured to manually operate the lead screw to rotate the lead screw, wherein the second receiving portion comprises a second hole and a second bearing fixedly mounted in the second hole for bearing the lead screw, and wherein the second bearing is configured to be mounted in the second hole from a side of the second hole facing the first receiving portion, and wherein the second hole and the second bearing have matching axial stops that define an axial position of the second bearing relative to the second hole and/or matching circumferential stops that define a circumferential position of the second bearing relative to the second hole.

17. The manual actuating device for a phase shifter according to claim 16, wherein the axial stop of the second hole is a step of the second hole, and the axial stop of the second bearing is a flange of the second bearing.

18. The manual actuating device for a phase shifter according to claim 17, wherein the circumferential stop of the second hole is a protrusion of the second hole, and the circumferential stop of the second bearing is a slot of the flange of the second bearing.

19. A manual actuating device for a phase shifter, wherein the actuating device comprises:

a support module having an elongated base body and a first and a second receiving portions protruding from the base body and spaced apart in a longitudinal direction of the base body;

a lead screw drive having a lead screw and a nut, wherein the lead screw is rotatably supported in the first and the second receiving portion, and the nut is translationally movably mounted on the lead screw;

an actuator rod connected to the nut and configured to actuate the phase shifter; and a manual operating part connected with the lead screw and configured to manually operate the lead screw to rotate the lead screw, wherein the actuating device comprises an additional support having a first receiving hole, and the nut of the lead screw drive has a second receiving hole, wherein a scale is received within the first and second receiving holes, and the scale has scale values for indicating electric tilt angles corresponding to positions of the actuator rod, wherein the scale is provided with a spring element, wherein a proximal end region of the scale abuts against an edge of the first receiving hole under a spring force of the spring element, and the scale can be pulled out from the first receiving hole and the second receiving hole under overcoming the force of the spring element until a distal end region of the scale abuts against an edge of the second receiving hole.

20. The manual actuating device for a phase shifter according to claim 19, wherein the additional support has a third receiving hole through which the manual operating part extends, optionally wherein an elastomeric element is provided between the manual operating part and the third receiving hole, and the elastomeric element can generate resistance to the operation of the manual operating part.

* * * * *